US006941771B2

(12) United States Patent
Reddick et al.

(10) Patent No.: US 6,941,771 B2
(45) Date of Patent: Sep. 13, 2005

(54) LIQUID NATURAL GAS PROCESSING

(75) Inventors: Kenneth Reddick, Houston, TX (US); Noureddine Belhateche, Houston, TX (US)

(73) Assignee: Howe-Baker Engineers, Ltd., Houston, TX (US)

( * ) Notice: Subject to any disclaimer, the term of this patent is extended or adjusted under 35 U.S.C. 154(b) by 532 days.

(21) Appl. No.: 10/115,150

(22) Filed: Apr. 3, 2002

(65) Prior Publication Data

US 2003/0188996 A1 Oct. 9, 2003

(51) Int. Cl.[7] ..... F25J 3/00; F25J 1/00
(52) U.S. Cl. ..... 62/620
(58) Field of Search ..... 62/620, 625, 632; 208/340, 308

(56) References Cited

U.S. PATENT DOCUMENTS

| | | | | |
|---|---|---|---|---|
| 3,261,169 A | | 7/1966 | Harmens | |
| 3,405,530 A | * | 10/1968 | Denahan et al. | 62/630 |
| 3,420,068 A | * | 1/1969 | Petit | 62/623 |
| 3,837,172 A | | 9/1974 | Markbreiter et al. | |
| 3,837,821 A | | 9/1974 | Buffiere et al. | |
| 5,114,451 A | | 5/1992 | Rambo et al. | |
| 5,402,645 A | | 4/1995 | Johnson et al. | |
| 5,561,988 A | | 10/1996 | Mehra | |
| 5,588,308 A | | 12/1996 | Daugherty et al. | |
| 5,687,584 A | | 11/1997 | Mehra | |
| 5,953,935 A | * | 9/1999 | Sorensen | 62/621 |
| 6,182,469 B1 | * | 2/2001 | Campbell et al. | 62/621 |
| 6,564,579 B1 | * | 5/2003 | McCartney | 62/620 |
| 6,604,380 B1 | * | 8/2003 | Reddick et al. | 62/620 |
| 2002/0029585 A1 | | 3/2002 | Stone et al. | |
| 2004/0025535 A1 | * | 2/2004 | Mak | 62/620 |

OTHER PUBLICATIONS

International Search Report for International Application No. PCT/US03/09942.
International Search Report for International Application No. PCT/US03/09948.

* cited by examiner

*Primary Examiner*—William C. Doerrler
(74) *Attorney, Agent, or Firm*—McDonnell Boehnen Hulbert & Berghoff LLP

(57) ABSTRACT

A process for the recovery of natural gas liquids (NGL) (ethane, ethylene, propane, propylene and heavier hydrocarbons) from liquefied natural gas (LNG) is disclosed. The LNG feed stream is split with at least one portion used as an external reflux, without prior treatment, to improve the separation and recovery of the natural gas liquids (NGL).

5 Claims, 1 Drawing Sheet

LIQUID NATURAL GAS PROCESSING

FIELD OF THE INVENTION

The present invention is directed toward the recovery of hydrocarbons heavier than methane from liquefied natural gas (LNG) and in particular to an improved process that uses a portion of the LNG as reflux in the separation process to aid in the recovery of the heavier than methane hydrocarbons.

BACKGROUND OF THE INVENTION

Natural gas typically contains up to 15 vol. % of hydrocarbons heavier than methane. Thus, natural gas is typically separated to provide a pipeline quality gaseous fraction and a less volatile liquid hydrocarbon fraction. These valuable natural gas liquids (NGL) are comprised of ethane, propane, butane, and minor amounts of other heavy hydrocarbons. In some circumstances, as an alternative to transportation in pipelines, natural gas at remote locations is liquefied and transported in special LNG tankers to appropriate LNG handling and storage terminals. The LNG can then be revaporized and used as a gaseous fuel in the same fashion as natural gas. Because the LNG is comprised of at least 80 mole percent methane it is often necessary to separate the methane from the heavier natural gas hydrocarbons to conform to pipeline specifications for heating value. In addition, it is desirable to recover the NGL because its components have a higher value as liquid products, where they are used as petrochemical feedstocks, compared to their value as fuel gas.

NGL is typically recovered from LNG streams by many well-known processes including "lean oil" adsorption, refrigerated "lean oil" absorption, and condensation at cryogenic temperatures. Although there are many known processes, there is always a compromise between high recovery and process simplicity (i.e., low capital investment).

The most common process for recovering NGL from LNG is to pump and vaporize the LNG, and then redirect the resultant gaseous fluid to a typical industry standard turbo-expansion type cyrogenic NGL recovery process. Such a process requires a large pressure drop across the turbo-expander or J.T. valve to generate cryogenic temperatures. In addition, such prior processes typically require that the resultant gaseous fluid, after LPG extraction, be compressed to attain the pre-expansion step pressure. Alternatives to this standard process are known and two such processes are disclosed in U.S. Pat. Nos. 5,588,308 and 5,114,457. The NGL recovery process described in the '308 patent uses autorefrigeration and integrated heat exchange instead of external refrigeration or feed turbo-expanders. This process, however, requires that the LNG feed be at ambient temperature and be pretreated to remove water, acid gases and other impurities. The process described in the '457 patent recovers NGL from a LNG feed that has been warmed by heat exchange with a compressed recycle portion of the fractionation overhead. The balance of the overhead, comprised of methane-rich residual gas, is compressed and heated for introduction into pipeline distribution systems.

Our invention provides another alternative NGL recovery process that produces a low-pressure, liquid methane-rich stream that can be directed to the main LNG export pumps where it can be pumped to pipeline pressures and eventually routed to the main LNG vaporizers. Moreover, our invention uses a portion of the LNG feed directly as an external reflux in the separation process to achieve high yields of NGL as described in the specification below and defined in the claims which follow.

SUMMARY OF THE INVENTION

As stated, our invention is directed to an improved process for the recovery of NGL from LNG which avoids the need for dehydration, the removal of acid gases and other impurities. A further advantage of our process is that it significantly reduces the overall energy and fuel requirements because the residue gas compression requirements associated with a typical NGL recovery facility are virtually eliminated. Our process also does not require a large pressure drop across a turbo-expander or J.T. value to generate cryogenic temperatures. This reduces the capital investment to construct our process by 30 to 50% compared to a typical cryogenic NGL recovery facility.

In general, our process recovers hydrocarbons heavier than methane using low pressure liquefied natural gas (for example, directly from an LNG storage system) by using a portion of the LNG feed, without heating or other treatment, as an external reflux during the separation of the methane-rich stream from the heavier hydrocarbon liquids, thus producing high yields of NGL. The methane-rich stream from the separation step is routed to the suction side of a low temperature, low head compressor to re-liquefy the methane rich stream. This re-liquefied LNG is then directed to main LNG export pumps.

In an alternate version of our process, the low pressure liquid LNG feed is spilt twice to supply two external reflux streams to two separation columns (for example, a cold separator and a stabilizer). The overhead from each of these towers is combined to form a methane rich stream substantially free of NGL. Possible variations of our process include recovering substantially all of the ethane and heavier hydrocarbons from the LNG, rejecting the ethane while recovering the propane and heavier hydrocarbons, or similarly performing this split of any desired molecular weight hydrocarbon. In one of the possible variations of our process, ethane recoveries are in the range of about 91 to 95% with 99+% propane-plus recovery. In another variation, a typical propane recovery in the ethane rejection mode of operation is from about 94 to about 96% with 99+% butane-plus recovery. Similarly, propane could be left in the gaseous stream while recovering 94 to 96% of the butanes.

DETAILED DESCRIPTION OF THE INVENTION

Figure 1:
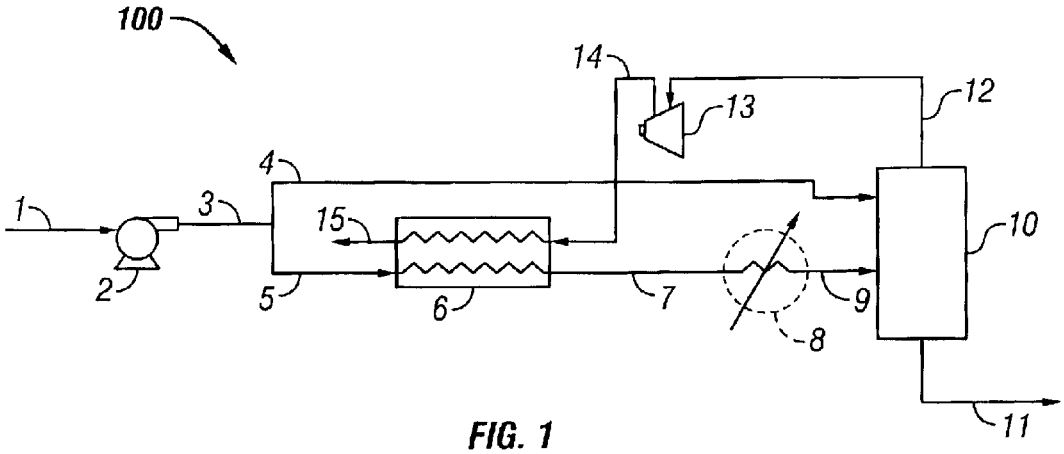
FIG. 1 is a schematic flow diagram of the method of the present invention.

Natural gas liquids (NGL) are recovered from low-pressure liquefied natural gas (LNG) without the need for external refrigeration or feed turboexpanders as used in prior processes. Referring to FIG. 1, process 100 shows the incoming LNG feed stream 1 enters pump 2 at very low pressures, typically in the range of 0–5 psig and at a temperature of less than −200° F. Pump 2 may be any pump design typically used for pumping LNG provided that it is capable of increasing the pressure of the LNG several hundred pounds to approximately 100–500 psig, preferably the process range of 300–350 psig. The resultant stream 3 from pump 2 is physically split into a first portion and a second portion forming streams 4 and 5 respectively, with a first portion (stream 5) preferably being 85–90% of stream 3 and the second portion (stream 4) preferably being 10–15% of stream 3. The split of stream 3 is necessary to the separation process because of the external reflux that stream 4 provides. The preferred relative portions of streams 4 and 5 are beneficial in providing the optimal amount of external reflux (depending on inlet stream composition) in order to maximize NGL recovery while maintaining low capital investment.

The first portion of the LNG feed in stream 5 is warmed by cross-exchange in heat exchanger 6 with substantially NGL-free residue gas in stream 15 exiting the process 100. After being warmed and partially vaporized, the LNG in stream 7 can be further warmed, if needed during process start-up, with an optional heat exchanger 8 (external heat supply) and then fed to separator 10. Separator 10 may be comprised of a single separation process or a series flow arrangement of several unit operations routinely used to separate fractions of LNG feedstocks. The internal configuration of the particular separator(s) used is a matter of routine engineering design and is not critical to our invention. The second portion of LNG feed in stream 4 is bypassed around heat exchangers 6 and 8 and is fed as an external reflux to the top of separator 10. The overhead from separator 10 is removed as methane-rich stream 12 and is substantially free of NGL. The bottoms of separator 10 is removed from process 100 through stream 11 and contains the recovered NGL product. The methane-rich gas overhead in stream 12 is routed to the suction of a low temperature, low head compressor 13. Compressor 13 is needed to provide enough boost in pressure so that stream 14 maintains an adequate temperature difference in the main gas heat exchanger 6 to re-liquefy the methane-rich gas to form stream 15. Compressor 13 is designed to achieve a marginal pressure increase of about 75 to 115 psi, preferably increasing the pressure from about 300 psig to about 350–425 psig. The re-liquefied methane-rich (LNG) in stream 15 is directed to the main LNG export pumps (not shown) where the liquid will be pumped to pipeline pressures and eventually routed to the main LNG vaporizers. Process 100 can also be operated in an "ethane rejection mode." The flow schematic for this mode is substantially similar to FIG. 1. The main difference in this mode of operation is that it is desirable to drive the majority of the ethane contained in feed stream 1 overhead in separator 10 so that stream 15 is comprised of mainly methane and ethane and the recovered NGL product stream 11 is comprised of propane and heavier hydrocarbons. Operation of this mode is typically accomplished by addition pre-heating of stream 9 and/or additional heating to the bottom of separator 10.

Figure 2:
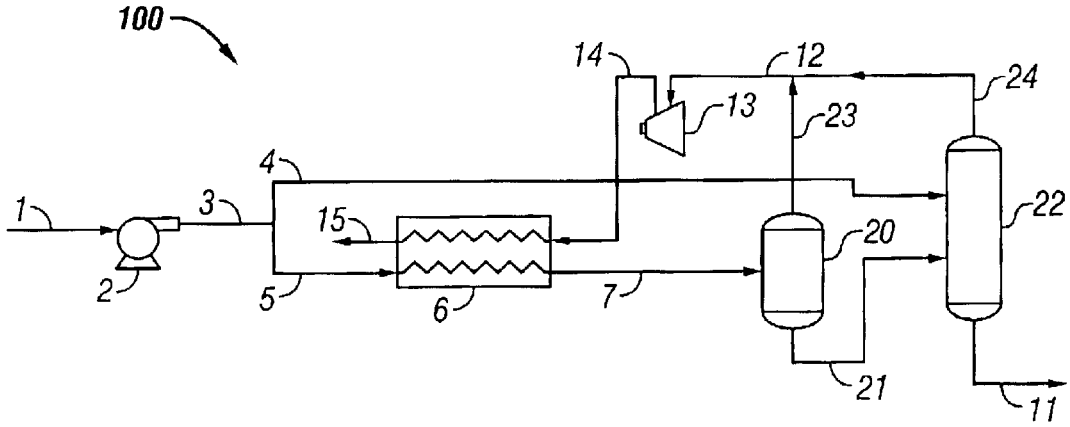
FIG. 2 is a schematic flow diagram of another method of the present invention.

FIG. 2 shows an alternate embodiment of our invention where stream 7 first undergoes separation in cold separator 20. Equivalent stream and equipment reference numbers are used to indicate identical equipment and stream compositions to those described previously in reference to FIG. 1. An NGL rich bottom stream 21 is removed from Separator 20 and eventually routed to a second separation process, such as stabilizer 22. A methane-rich overhead stream 23 is removed from cold separator 20 and eventually combined with methane-rich overhead stream 24 removed from stabilizer 22. A recovered NGL product stream 11 is removed from stabilizer 22 and routed to NGL storage or pumped to an NGL pipeline or fractionator (not shown). As with the embodiment shown in FIG. 1, incoming LNG feed 1 is separated after pump 2 to produce a slip stream 4 containing untreated LNG. Stream 4 is used as an external reflux in stabilizer 22 to assist in the separation of the methane-rich components from the NGL products, which are eventually removed via stream 11. Stream 4 works extremely well as a reflux because it is very cold (typically around −250° F.) and because it is very lean. Stream 4 is mostly comprised of methane; thus, it is very effective in removing heavier hydrocarbon compounds from the overhead of stabilizer 22.

Figure 3:
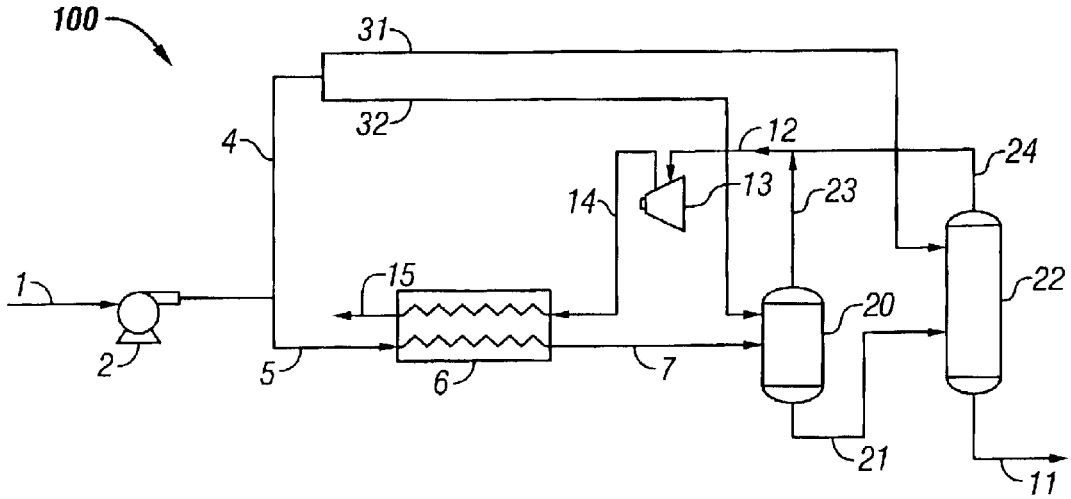
FIG. 3 is a schematic flow diagram of yet another method of the present invention.

Yet another embodiment of our invention is shown in FIG. 3, where, like the process of FIG. 2, two or more separators (cold separator 20 and stabilizer 22) are used in series to achieve ethane recoveries of 91 to 95% and 99+% propane recover. In this case, the LNG feed is split twice, first to create stream 5 that is used in heat exchange with compressed methane-rich stream 14 and also to create stream 4 comprising untreated LNG feed. Stream 4 is then split into streams 31 and 32, which are used as external reflux for stabilizer 22 and cold separator 20, respectively.

As one knowledgeable in this area of technology, the particular design of the heat exchangers, pumps, compressors and separators is not critical to our invention. Indeed, it is a matter of routine engineering practice to select and size the specific unit operations to achieve the desired performance. Our invention lies with the unique combination of unit operations and the discovery of using untreated LNG as external reflux to achieve high levels of separation efficiency in order to recover NGL.

While we have described what we believe are the preferred embodiments of the invention, those knowledgeable in this area of technology will recognize that other and further modifications may be made thereto, e.g., to adapt the invention to various conditions, type of feeds, or other requirements, without departing from the spirit of our invention as defined by the following claims.

We claim:

1. A process of recovering hydrocarbons heavier than methane from liquefied natural gas (LNG) comprising, a) continuously providing liquid, low pressure LNG to a feed pump;

b) increasing the pressure of the liquid, low pressure LNG to greater than 100 psia;

c) splitting the pressurized liquid LNG into first and second portions;

d) warming the first portion of pressurized liquid LNG from step c) to a temperature of greater than −250° F.;

e) separating the heated first portion of pressurized liquid LNG from step d) into a methane rich stream and a heavier hydrocarbon liquid stream;

f) using the second portion of the pressurized liquid LNG without heating as an external reflux during the separation of the methane rich stream from the heavier hydrocarbon liquid stream;

g) removing the heavier hydrocarbon liquid stream from the process for storage or pipeline transportation;

h) compressing the separated methane rich stream; and i) cooling and liquefying all of the compressed methane rich stream by heat exchange with the first portion of the liquid pressurized LNG.

2. The process of claim 1 where the liquefied compressed and cooled methane rich stream is removed from the process for storage or ultimate routing to LNG vaporizers.

3. The process of claim 1 where the separation of hydrocarbons heavier than methane occurs in a two-step process, a first flash process followed by a second distillation process.

4. The process of claim 1 where the liquid low pressure LNG is at a pressure of from about 0 to about 20 psia.

5. A process of recovering hydrocarbons heavier than methane from liquefied natural gas (LNG) comprising, a) continuously providing liquid, low pressure LNG to a feed pump;

b) increasing the pressure of the liquid, low pressure LNG to greater than 100 psia;

c) splitting the pressurized liquid LNG into first and second portions;

d) heating the first portion of pressurized liquid LNG from step c) to a temperature of greater than −250° F.;

e) splitting the second portion of pressurized liquid LNG into a first external reflux and a second external reflux;

f) separating the heated first portion of pressurized liquid LNG from step d) into a first methane rich stream and a first heavier hydrocarbon liquid stream;

g) using the first external reflux without heating during the separation of the first methane rich stream from the first heavier hydrocarbon liquid stream;

h) separating the first heavier hydrocarbon liquid stream into a second methane rich stream and a second heavier hydrocarbon liquid stream;

i) using the second external reflux without heating during the separation of the second methane rich stream from the second heavier hydrocarbon liquid stream;

j) removing the second heavier hydrocarbon liquid stream from the process for storage or pipeline transportation;

k) combining and compressing the first and second methane rich streams to form methane rich LNG;

l) cooling and liquefying all of the methane rich LNG by heat exchange with the first portion of the liquid pressurized LNG; and m) removing the compressed and cooled methane rich LNG from the process for ultimate routing to LNG vaporizers.

* * * * *